US007303093B2

(12) United States Patent
Ward

(10) Patent No.: US 7,303,093 B2
(45) Date of Patent: Dec. 4, 2007

(54) HOT FOOD VENDING MACHINE

(75) Inventor: Glen Ward, Grass Valley, CA (US)

(73) Assignee: Abudanza Inc., Kailua, HI (US)

( * ) Notice: Subject to any disclaimer, the term of this patent is extended or adjusted under 35 U.S.C. 154(b) by 243 days.

(21) Appl. No.: 10/551,121

(22) PCT Filed: Mar. 24, 2004

(86) PCT No.: PCT/US2004/009423

§ 371 (c)(1),
(2), (4) Date: Sep. 23, 2005

(87) PCT Pub. No.: WO2004/086317

PCT Pub. Date: Oct. 7, 2004

(65) Prior Publication Data

US 2006/0196883 A1 Sep. 7, 2006

Related U.S. Application Data

(60) Provisional application No. 60/457,427, filed on Mar. 24, 2003.

(51) Int. Cl.
*G07F 11/04* (2006.01)

(52) U.S. Cl. ..... 221/150 HC; 221/150 A; 221/150 R

(58) Field of Classification Search ..... 221/150 HC, 221/150 A
See application file for complete search history.

(56) References Cited

U.S. PATENT DOCUMENTS 4,398,651 A 8/1983 Kumpfer
4,592,485 A 6/1986 Anderson et al.
4,783,582 A 11/1988 Kikuo et al.
5,210,387 A * 5/1993 Smith et al. ..... 221/150 HC
5,266,766 A * 11/1993 Hecox ..... 221/150 A
5,378,872 A 1/1995 Jovanovic
5,522,310 A 6/1996 Black et al.
5,997,924 A 12/1999 Olander et al.
6,024,013 A 2/2000 Masoud
6,067,898 A 5/2000 Chun-Yuan
6,086,934 A 7/2000 Khatchadourian et al.
2001/0002674 A1 6/2001 Gubbini et al.

* cited by examiner

*Primary Examiner*—Gene O. Crawford
*Assistant Examiner*—Timothy Waggoner
(74) *Attorney, Agent, or Firm*—Barbara J. Luther; The Luther Law Firm PLC

(57) ABSTRACT

A heated food vending machine has a front with a) slots for dispensing the food and for accepting money, b) a video screen and c) several depressible buttons. Inside the machine is a refrigerator with a roof having an openable door and a side having a fastenable door for refilling with food in covered pans. Inside the refrigerator is a horizontally rotating apparatus with stations supporting stacks of food in covered pans. An elevator below the openable door elevates a station, raising the top pan above the door. The food cover is removed by a special roller apparatus. On top of the refrigerator are arms radiating from a central hub, which are rotate horizontally. Spaces between the arms contain food pans, which rotate to an oven with heating elements above and below the pizza. A computer controls the food selection and the refrigerator and oven temperatures.

5 Claims, 7 Drawing Sheets

HOT FOOD VENDING MACHINE

RELATED APPLICATIONS

This application is a 35 U.S.C. 371 application based on PCT/US2004/009423, filed Mar. 24, 2004, which claims priority from U.S. provisional application 60/457,427, filed Mar. 24, 2003. These applications are hereby incorporated by reference.

BACKGROUND

1. Field of the Invention

The present invention relates to a vending machine for heating and dispensing food.

2. Prior Art

Vending machines for dispensing hot and cold drinks, candy, cookies, potato chips and other snack foods have enjoyed significant commercial success. However, vending machines for dispensing meals have been limited to dispensers of refrigerated foods such as sandwiches, salads and the like.

Devices heretofore devised for incorporating electronic ovens in food vending machines are disclosed in U.S. Pat. No. 3,333,666; U.S. Pat. No. 3,343,479; U.S. Pat. No. 3,386,550; U.S. Pat. No. 3,397,817; U.S. Pat. No. 3,534,676; U.S. Pat. No. 4,004,712; U.S. Pat. No. 4,398,651; U.S. Pat. No. 4,592,485; U.S. Pat. No. 4,762,250; U.S. Pat. No. 4,783,582 and U.S. Pat. No. 4,784,292.

Vending machines for hot meals generally include a refrigerated compartment for preserving food, a microwave oven compartment for fast cooking, and a conveyor for transferring food from the refrigerated compartment into the microwave oven. However, since vending machines for hot foods have enjoyed very limited commercial success, separate microwave ovens for heating food items removed from a refrigerator are commonly employed in convenience stores, airports, cafeterias and other food vending operations.

Microwave heating of certain foods, including pizza and sandwiches which contain dough and bakery products typically leaves the surface too moist and less palatable than similar food products cooked in other types of ovens.

Ovens of the type disclosed in U.S. Pat. No. 3,884,213; U.S. Pat. No. 4,154,861; U.S. Pat. No. 4,289,792; U.S. Pat. No. 4,409,453 and U.S. Pat. No. 4,835,351 employ air jets which impinge upon the surface of a food product to provide surface heating of the product in combination with microwave heating. Jet impingement ovens have enjoyed significant success in commercial food service and commercial food processing operations.

An important consideration in the dispensing of food products from vending machines is one of convenience. It is generally recognized that the desire to obtain food products from vending machines is heavily dependent upon considerations of time. In dispensing food products at room temperature, or at reduced temperatures, such considerations are not important since the desired food product can be vended directly from the storage compartment of the vending machine. However, in dispensing food products which need to be warmed, or even heated, considerations of time become significantly more important in that a certain amount of time is necessary to properly raise the temperature of the food product which is to be dispensed, prior to its delivery from the vending machine. Indeed, it is generally believed by those in the industry that time periods of even two or three minutes could represent a significant impediment to the interest on the part of the general public in obtaining heated food from a vending machine. Prevailing opinion is that consumer interest is generally limited to time periods on the order of one minute or less, representing a rather short period of time in which to completely heat and vend a given food product.

Yet another consideration is that of the food product which is to be dispensed from the vending machine. Certain types of foods are well suited to rapid heating techniques, using any of a variety of oven types (e.g., electric heating, infrared heating, convection heating, microwave heating, etc.). Examples of these are available with reference to the patents which are identified above. However, it has been found that some food products are not well suited to heating and dispensing from a vending machine. One example of this is the pizza, which the above-described devices are not well suited to handling.

A key reason for this is that despite the wide popularity of pizza, which is one of the most frequently consumed food types in the United States, food service companies have been unable to produce a frozen pizza which is suited to rapid heating and cooking techniques adaptable to a vending machine. Specifically, a pizza which is well suited to microwave cooking, one of the most rapid cooking techniques available, has not yet been developed. As a result of this, vending machines for handling pizza products have not been forthcoming.

The reasons for this are primarily two-fold. First, even the best so-called "microwavable" pizzas tend to be less than acceptable in consistency. Available pizza products exhibit drawbacks ranging from poor taste, to unacceptably doughy crusts, hard chewing crusts, uneven cooking, and at times, a cardboard-like consistency. Second, available "microwavable" pizzas could not, even under the best of circumstances, be cooked in less than approximately three minutes, significantly in excess of the period of time deemed advisable for maintaining consumer interest in obtaining a particular food product from a vending machine.

What is needed is an improved method and machine for cooking a pizza, so that the pizza crust is crisp and the cheese is melted and preferably browned.

SUMMARY OF THE INVENTION

In one embodiment, there is provided a vending machine for selling heated food in a pan. The machine has a housing with four sides, a base and a top, at least one side being capable of opening. The housing opening side has several slots, one slot for dispensing a heated food in a pan and other slots for accepting money or its equivalent. The housing opening side also has a video screen and optionally depressible buttons. Within the housing is a refrigerator having sides, a roof and a floor. The refrigerator roof has an opening door; the side has a fastenable door. Within the refrigerator is a horizontally rotating apparatus having a plurality of stations, each of which can carry a stack of food pans, with one food pan on top. Positioned below the roof door is an elevator capable of elevating a station such that the top food pan is raised above the refrigerator roof. There is also a means for removing a cover from the food pan; On top of the refrigerator roof are arms radiating from a central hub, the arms being rotated horizontally and forming a plurality of spaces for carrying the food pans, whereby the arms push the pans around the refrigerator roof. The arms push the food pan into an oven having a first heating element positioned above the food pan in the top, a second heating element positioned below the pan in the bottom, sides formed by the two arms on either side of the food pan and an outer wall connecting the top and bottom of the oven. A computer transmits a food selection and controls the refrigerator and oven temperatures.

In another aspect, the means for removing the cover from the food pan has two closely apposed movable rollers which move in opposite directions and are positioned above the pizza pan and a source of air positioned below the film covering, whereby the air blows upward an edge of the film covering which is then grasped between the two rollers which turn and pull the film covering from the pizza pan.

In yet another aspect, the video screen is a touch screen for selecting the food.

In another aspect, the openable door in the refrigerator roof further has a motor to slide the door open.

A pizza vending machine has a housing with four sides, a base and a top, at least one side (the front) being capable of opening. The front has several slots, one slot for dispensing a pizza and other slots for accepting money or its equivalent. The front also has a video screen to show available selections and directions and several depressible buttons arranged around the screen. Inside the housing is an insulated vessel that has cylindrical or rectangular sides, a top and a bottom, the top having a openable door and the side having a fastenable door through which the pizzas in covered pans can be inserted to refill the machine. A compressor connects to the vessel to cool the pizzas within the vessel. Within the vessel, there is a horizontally rotating apparatus that has a plurality of stations, each station capable of carrying a stack of pizzas, and each station separated from the adjacent station with spacers which maintain the stack of pizzas on the station. An elevator is positioned below the openable door of the vessel and is capable of elevating a station such that a top pizza of the pizza stack is raised out of the vessel. The pizza covering is removed from a pizza pan by an apparatus comprising two closely apposed movable rollers, which move in opposite directions and are positioned above the pizza pan, and a source of air positioned below the film covering, whereby the air blows upward an edge of the pizza covering, which is then grasped between the two rollers that turn and pull the pizza covering from the pizza pan. There is a plurality of arms arranged in a spoke-like fashion on top of the vessel, said arms being rotated horizontally by a motor, a plurality of spaces between the arms for containing pizza pans, whereby the arms rotate horizontally and push the pizzas around the top of the vessel. An oven has a first heating element positioned above the pizza and in the top of the oven, a second heating element positioned below the pizza in the base of the oven, two sides formed by the arms on either side of the pan and a lateral side connecting the top and base of the oven. A computer controls the selection of the pizza to be dispensed and the temperatures of the drum and the oven.

DETAILED DESCRIPTION OF THE INVENTION

An automated pizza cooking and dispensing apparatus and method provides a stand alone, self-contained automatic, self-service, unattended, storage, cooking and vending apparatus. The vending machine is easy to service and maintain in a sanitary condition.

Figure 1:
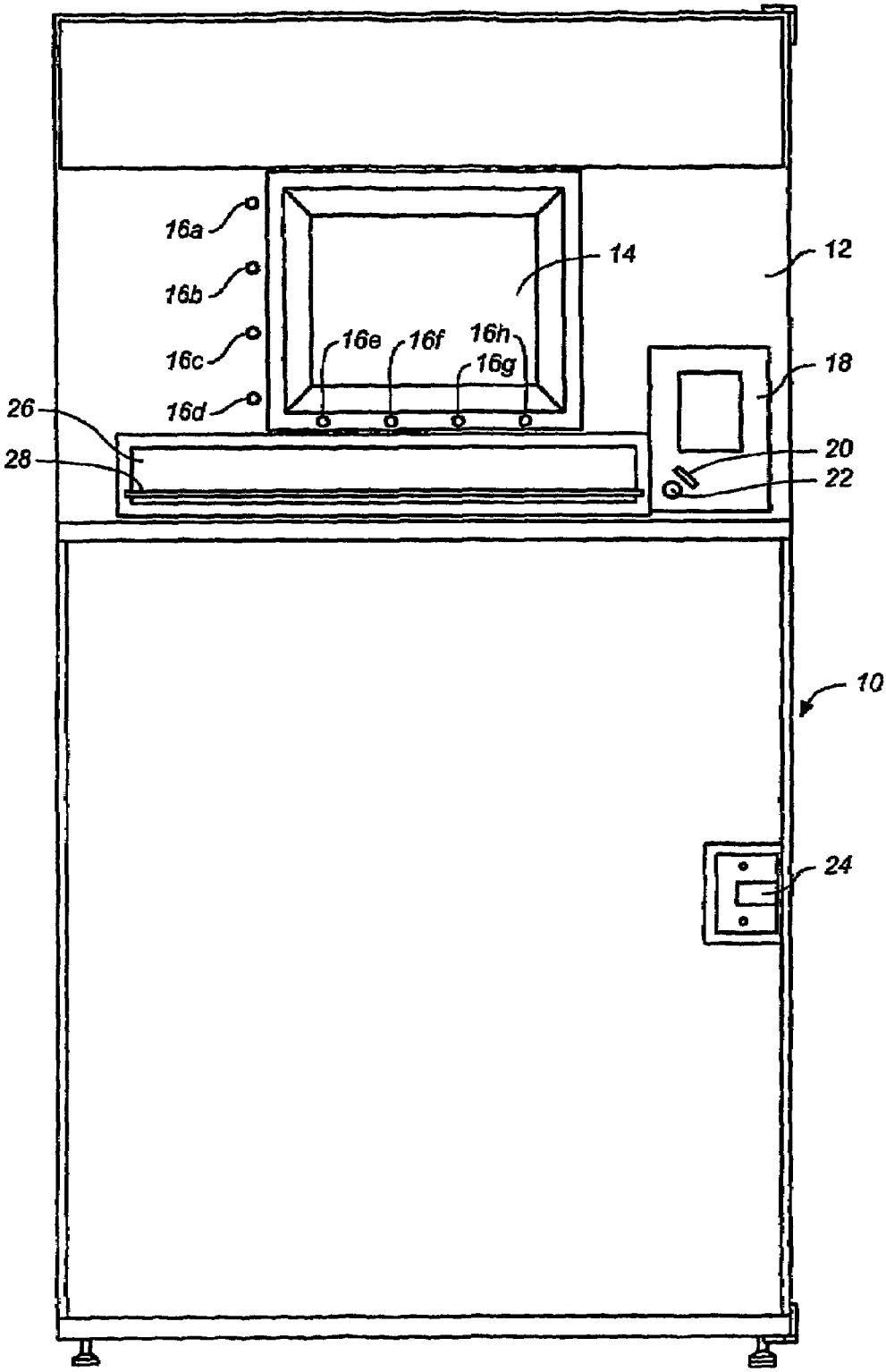
FIG. 1 shows the front of the pizza vending machine.

FIG. 1 shows the vending machine's 10 front 12, with which the customer interacts. There is a monitor screen 14, which displays directions for ordering the different refrigerated pizzas. The monitor screen 14 can be a cathode ray tube (CRT) or a flat panel liquid crystal display, active matrix or passive matrix for compactness, less weight and smaller size. In schools and other "hard use" situations, the monitor 14 is covered with a thick clear plastic to avoid damage. In other locations, the monitor screen 14 can be a touch screen with pressure- or heat-sensitive sensors which provide controls to detect and sense a finger of a customer selecting the desired pizza. Besides showing ordering information, the screen could also show a computer game or commercial messages to entertain the waiting customer.

In one embodiment shown in FIG. 1, there are buttons (16*a*-16*h*), which can be used to select the type of pizza and other functions. Once the pizza is ordered, the buttons can optionally be used to operate a computer game. The number of buttons is not critical.

Payment equipment 18 is also conveniently accessed by the customer. Payment equipment 18 accommodating limited types of coins with a coin slot 20, paper money and credit or debit cards can be provided by a number of vendors. A preferred cash handling equipment is the Quantum 70 series of coin holders/dispensers. In one embodiment, there is provided one price for cheese pizza (e.g., $3.00) and another price for pepperoni pizza (e.g., $3.25). There the vending machine accepts only quarters and dollar coins, as well as paper money up to $20 denomination and credit and debit cards. If the customer made a mistake in selection or payment, the coin return button 22 can be pushed and the coins drop to the coin return slot 24. Preferably, there is a credit card reader (not shown) to receive and read a customer's plastic card, such as a bank card, or prepaid cash card. A modem (not shown) is connected to the credit card reader and CPU (see below) to verify and transmit information about the customer's card to a remote processing center. This connection can be via a phone line or cell phone. The amount to be debited is determined from the button pressed. The modem can be used for card verification as well as for system error reporting and troubleshooting. Should a malfunction or error occur (e.g., too few pizzas, incorrect temperature, safety shutdown, or damage due to tampering or vandalism), the modem can be programmed to call a telephone number to report this problem and information. After the customer's card is verified and the customer's account is debited, the pizza vending process begins.

Also on the vending machine's front 12 are the pizza-dispensing slot 26 and a tray 28 onto which the pizza slides before the customer picks it up.

A central processing unit (CPU) (not shown) is just inside the door and is connected to the monitor 14 and buttons 16*a*-16*h* to receive and transmit electrical impulses. The CPU can be a microprocessor, computer, electronic chip, control board, logic controller, or a programmable controller. The CPU coordinates the monitor and buttons, along with a card reader and modem, as well as other sensors (such as for refrigerator and oven temperatures) and control systems. The CPU can be both programmable and expandable to accommodate desired changes and variations for a specific location or group of customers. The CPU can control and monitor the automatic functions for selecting, cooking and dispensing pizzas. The CPU can have an analog I/O for the described automatic functions and a data I/O for the monitor and buttons as well as a modem interface. The CPU also coordinates with safety check circuitry to provide safety checks for the components and operations of the system for safeguards, specification requirements and regulatory compliance (e.g., refrigerator temperature monitoring).

Figure 2:
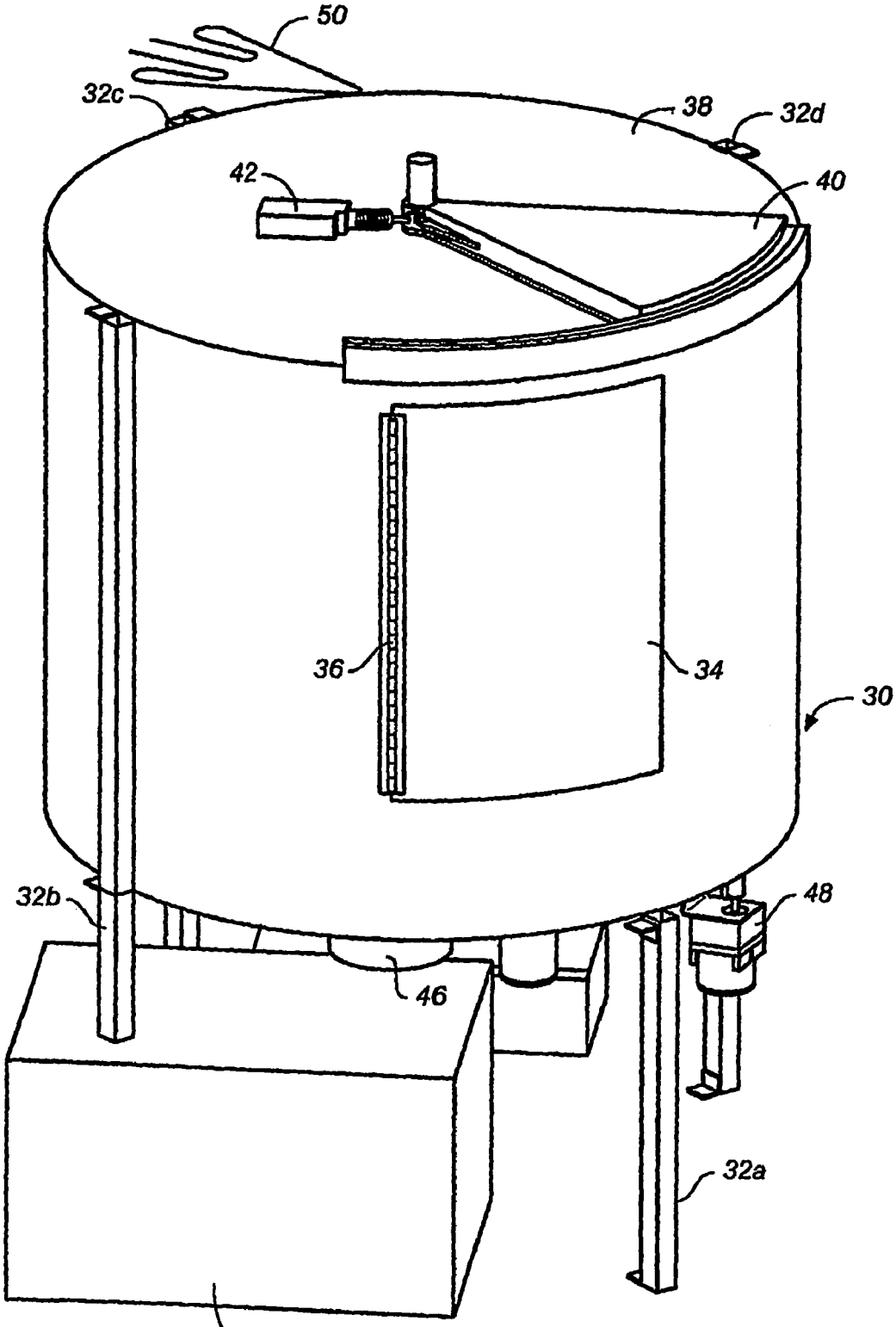
FIG. 2 shows the insulated vessel inside the pizza vending machine.

FIG. 2 shows a schematic of a refrigerated vessel 30, which stores the premade pizzas in foil pans covered with film (e.g., plastic or foil), which has a leading lip (see below). In one embodiment, the vessel is a drum 30 that stands on legs 32*a*-32*d*. The drum 30 side has a door 34 with hinges 36, which the vendor opens to restock the pizzas. In one embodiment, the drum 30 is made from two concentric layers of tough plastic, which form a space that is filled with insulation. The drum 30 has a top 38 that is also insulated. A wedge-shaped portion of the top is an openable lid 40, which is positioned by a motor 42. The refrigerator drum 30 has a compressor 44 which sends cold air into the drum 30 through a hose (not shown). There is another motor 46 that rotates the pizzas inside the drum 30. In addition, there is a motor 48 that elevates a stack of selected pizzas. Shown at the top of FIG. 2 is an electrical heating element 50 that is used to heat the pizza slice.

Figure 3:
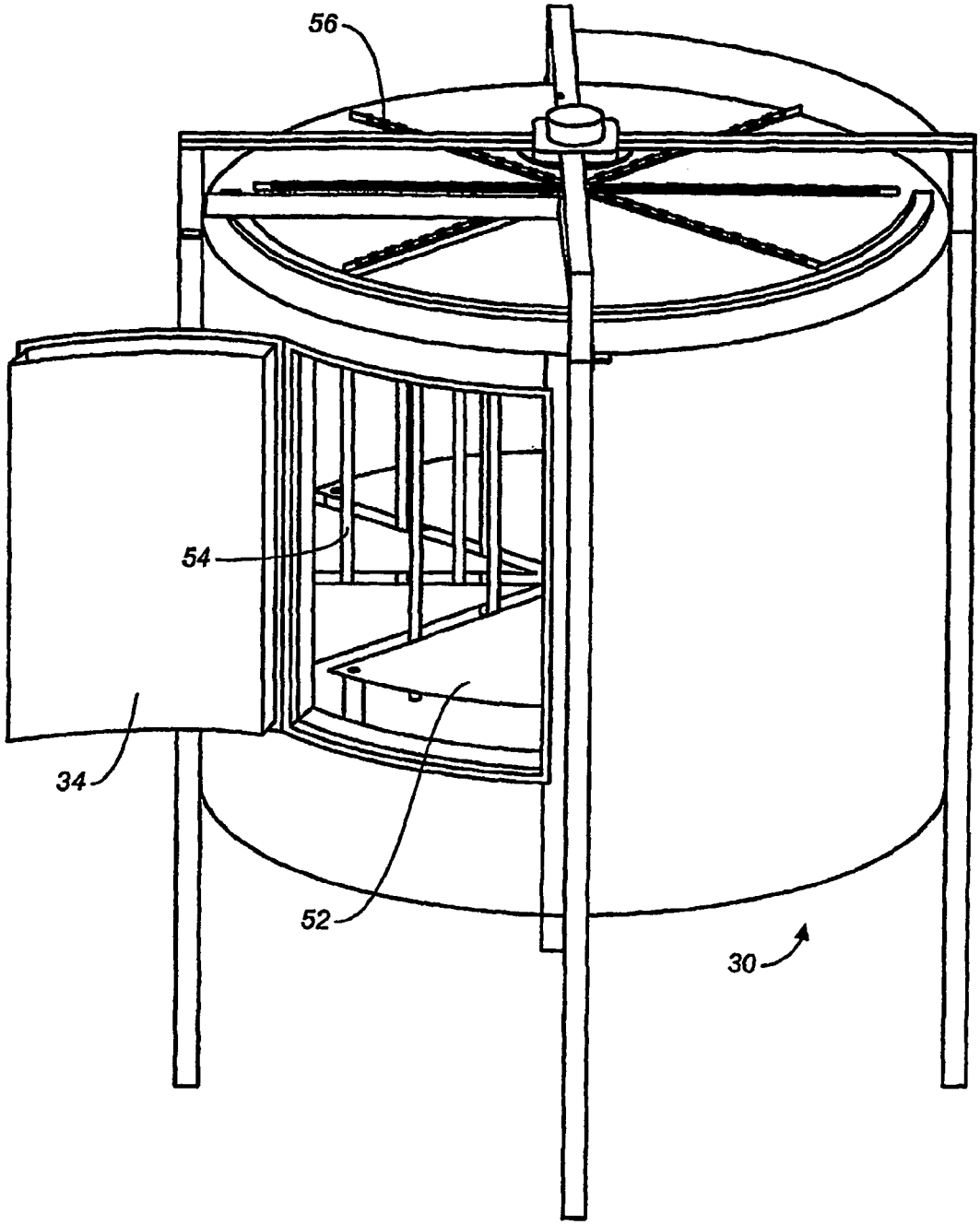
FIG. 3 is a photograph of the opened vessel and the stations for stacks of pizzas.

FIG. 3 shows the interior of the drum 30 with the door 34 opened, as for vendor access. Inside is a plurality of stations, one of which is marked 52. Between each station are shown spacers 54, which in this embodiment comprise multiple rods. The pizza pies are arrayed in stacks over each station. Preferably all the pizza pies on an individual station 52 are the same (e.g., cheese or pepperoni).

Above the refrigerated drum 30 can be seen a plurality of arms (such as 56) arranged in a spoke-like fashion. Like spokes, these arms are fixed to a central shaft, which moves all of the arms at the same time. The wedge-shaped space between adjacent arms accommodates the pizza-slice container. The station 52 with the desired pizza is rotated to a position over the elevator motor 48, which turns a screw to raise the pizza pan out of the drum 30, whereupon the pizza pan contacts arm 56 which sweeps the pizza pan off the pizza column and forward onto a platen (not shown) to an unwrapping apparatus.

Figure 4:
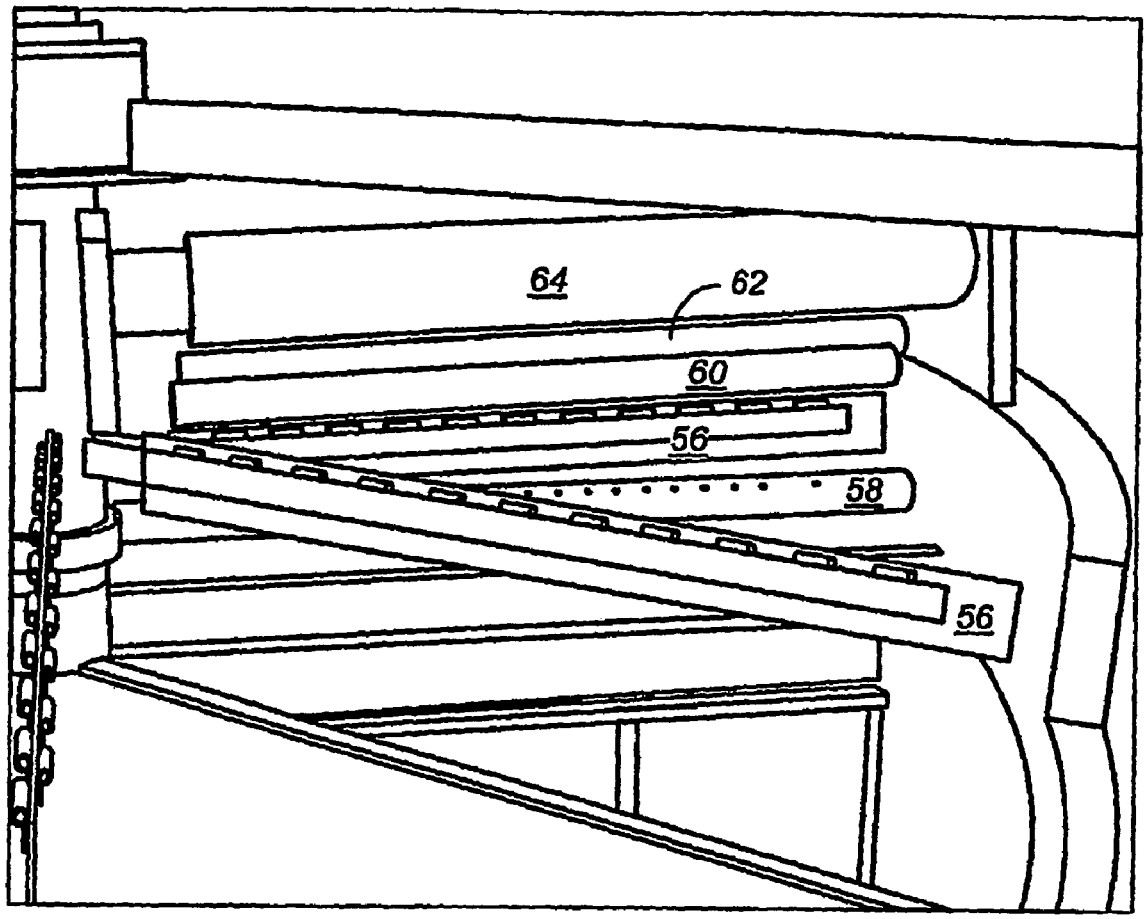
FIG. 4 shows the unwrapping apparatus and the rotating arms that move the pizza.
Figure 5:
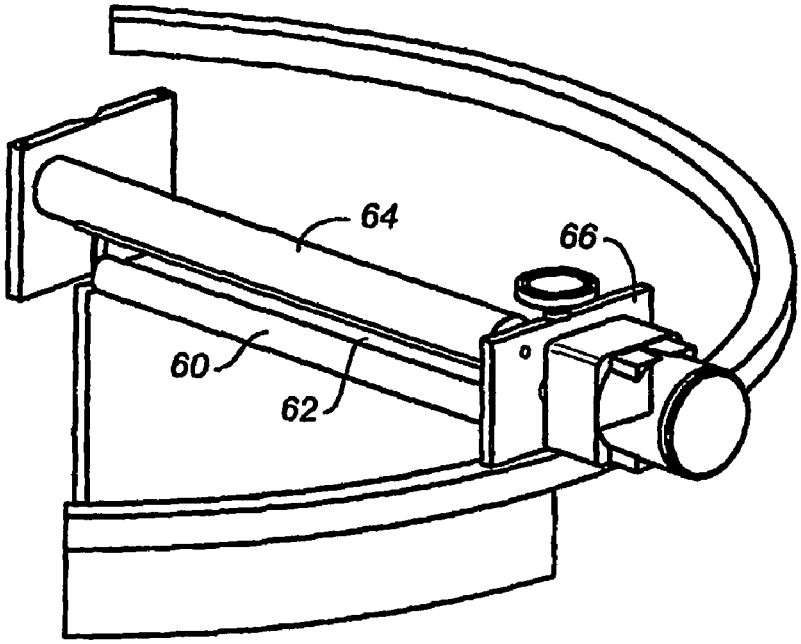
FIG. 5 is a schematic of the unwrapping apparatus with three rollers and an end support.

FIG. 4 shows the unwrapping apparatus with the arms 56 and pizza pan sweeping through the middle of it. The unwrapping apparatus has four parts: a close-ended tube 58 that expels air through small holes and that is below the pizza pan, two closely apposed rollers 60 and 62, and a third plastic-covered roller 64 above the two rollers. This is shown in more detail in FIG. 5, which also shows a removable end support 66 for the three rollers.

Figure 6:
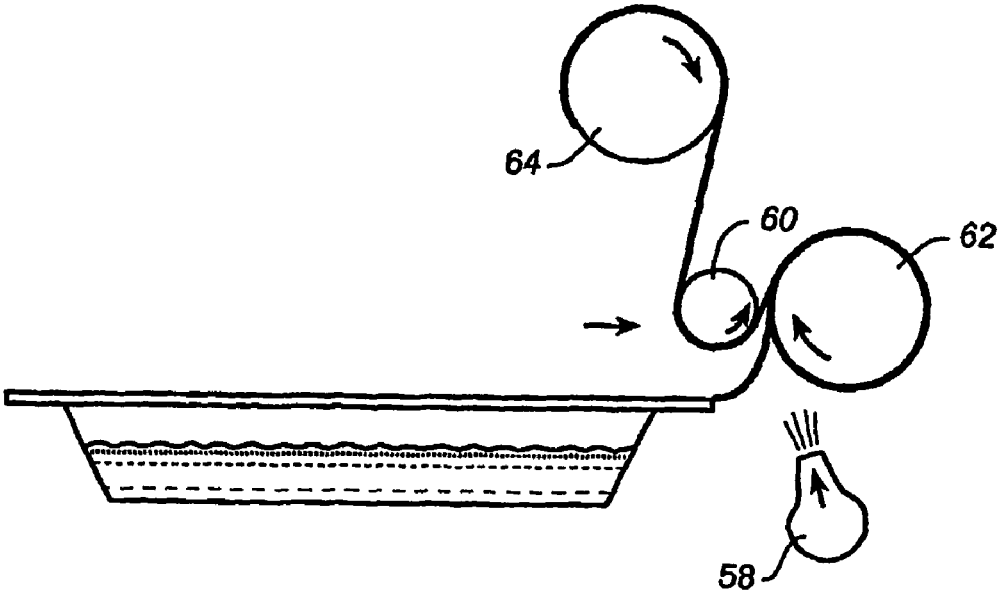
FIG. 6 is a schematic cross section of the unwrapping apparatus, which shows the air blower pushing up the edge of the film covering between the two lower rollers and plastic wrap coming from the third roller to enclose the film covering from the pizza pan.

This unwrapping apparatus solves difficult problems. First, the pizza plastic cover needs to be removed so that the pizza can be heated quickly at high temperature. Second, the removed plastic cover may have pizza topping adhering to its underside. Such food must be disposed of in a sanitary way and cannot be allowed to accumulate and spoil in the vending machine. The outside edge or leading lip of the film covering is blown upward by the air tube 58 into the space between rollers 60 and 62, which move in opposite directions to pull the cover onto roller 62. Simultaneously, the plastic on roller 64 unrolls and covers the film covering that is on roller 62. That way the pizza topping is enclosed with unrolled plastic that prevents air from contacting the discarded film covering with pizza topping, an arrangement that prevents spoilage. FIG. 6 shows a side view of the unwrapping apparatus. Arrows indicate the directions in which the rollers 60, 62, and 64 turn to remove the pizza pan film covering and enclose it in plastic wrap.

Figure 7:
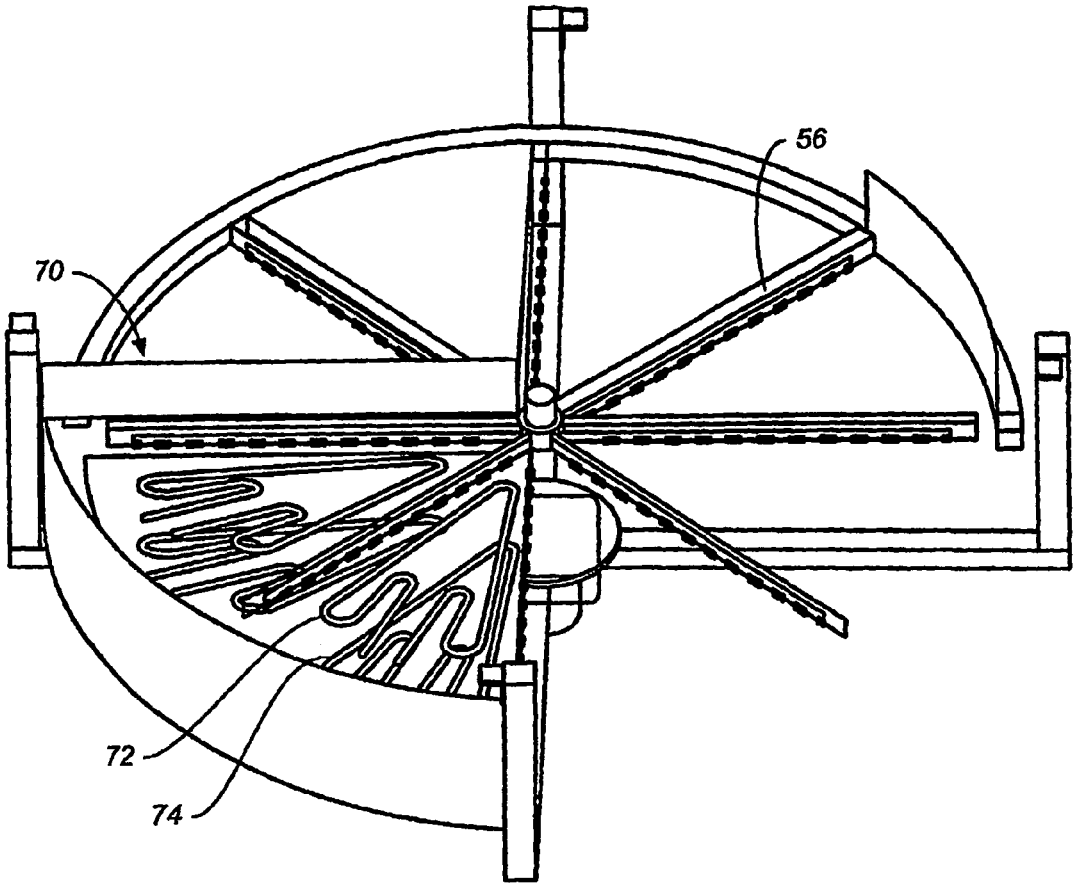
FIG. 7 shows the oven in detail, including the upper and lower heating elements.
Figure 8:
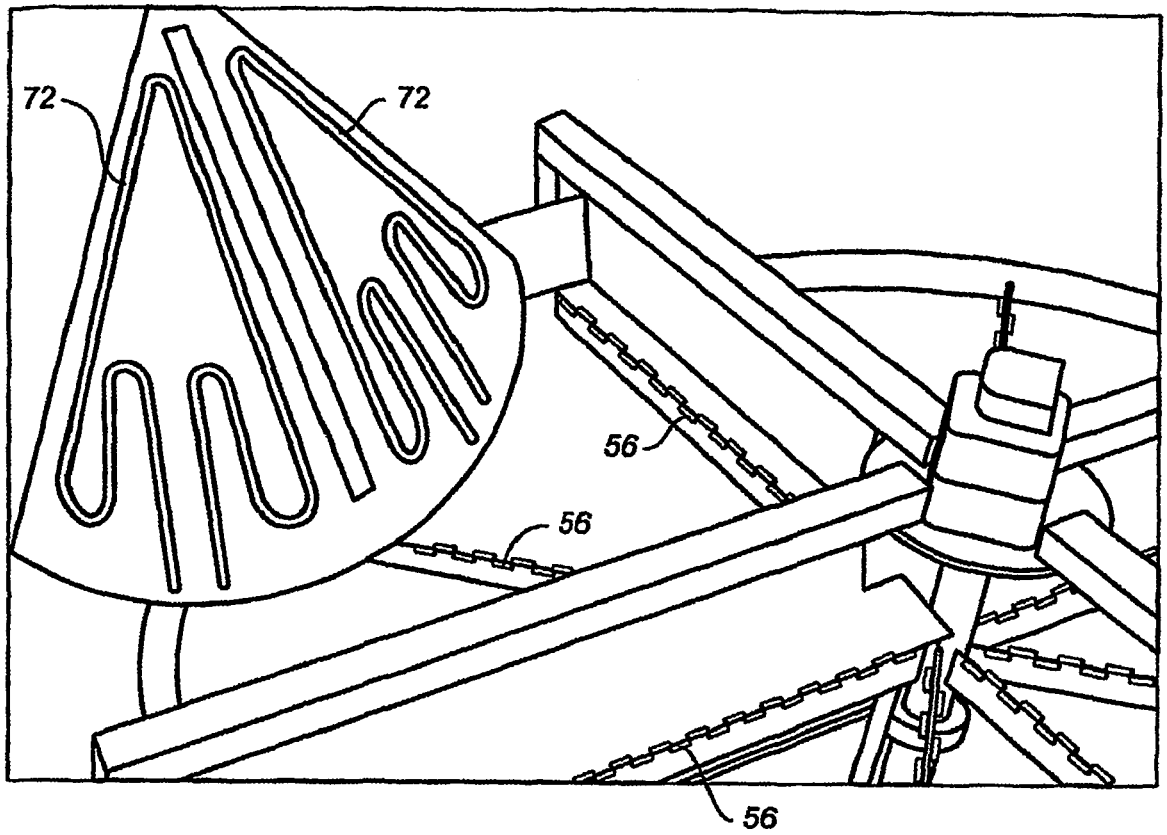
FIG. 8 is a photograph of the upper heating elements.

The arms 56 continue to carry the pizza pan around on a platen until the pizza pan reaches one of the dual ovens 70, shown in FIG. 7. For rapid cooking, there are electric heating elements 72 immediately above the pizza, which heat quickly to high temperatures, such as about 1000° F., to rapidly heat the pizza and brown the cheese. In the floor of the oven there is another heating element 74 that heats the floor of the oven, heats the heat-conductive pizza pan, which in turn heats and crisps the pizza crust. The arms 56 are positioned in the space at the edges of the oven 70 (on either side of the pizza), creating side doors and preventing heat from escaping. FIG. 8 shows an oven that has been taken apart so that the pair of upper heating elements 72 can be seen more easily. In one embodiment, both upper and lower heating elements 72 and 74 are the same configuration. The heating elements can be any shape that would provide rapid overall heating. Because the heating elements draw exceedingly high current, it may be preferable to have rechargeable batteries to supplement incoming current. In periods of non-use, the batteries would recharge.

The CPU via heat sensors monitors the oven temperature and adjusts the time that the pizza spends in the oven. In one embodiment, the CPU is programmed to preheat the oven, for example, for lunch times and snack times. In another embodiment, the CPU is programmed to compute trends from actual use of the individual vending machine and to establish pre-heating schedules based thereon. For example, the vending machine at a preparatory school would determine that it should only preheat on weekdays for scheduled breaks and lunch periods; whereas, a college dormitory machine would preheat for late night snacking.

In operation, the customer orders a pizza by touching the buttons adjacent the monitor. Once the selection has been made, a total dollar amount is displayed. If the customer is satisfied with the selection and price, the customer then pays for the pizza. In a machine charging $3.00 for cheese pizza and $3.25 for pepperoni pizza, the machine accepts quarter and dollar coins and paper currency. Alternately, the customer can insert a credit card, ATM card, debit card, or prepaid cash card into the card reader. The name and identification number of the card holder and purchase price are transmitted from the card reader via the modem to a financial institution for verification and debiting.

After the pizza is ordered and payment completed, the CPU selects the station that has the ordered type of pizza to move under the openable door of the refrigerated drum. The motor pushes the door sideways and open. The CPU "remembers" how many pizzas are in the stack and instructs the elevator to elevate the top pizza to a height which will allow the arms to move the pizza onto the platen. The arms position the pizza at the unwrapping apparatus, where the air tube blows the edge of the film covering toward the closely apposed rollers, which pull the cover off the pizza as it moves under the rollers. The pizza is then rotated into the oven (which may have already been heating up) and flash cooked. When the proper temperature has been maintained for the appropriate time, the arms again rotate the pizza, this time toward a downward sloping ramp, and the pizza slides onto the tray where the customer can receive it.

The pizza vending machine has also been designed for ease of restocking. The vendor opens the front door of the cabinet and immediately has access to the money and the CPU which is equipped with a keyboard or other pad to key in information on pizza location, new pricing, new commercials, etc. On top of the drum, the vendor removes the removable support from the unwrapping apparatus, removes the roll of pizza film covers and replaces the plastic sheeting (on roller 64), and feeds the plastic sheeting between rollers 60 and 62 and around roller 62. Then the vendor opens the refrigerated drum door and refills the stacks of pizza slices, with each stack having all the same type of pizza. As the vendor refills the stacks, he reprograms the CPU to reflect the type of pizza slices on stack 1, stack 2 and so on through stack 8. Optionally, the vendor can run a check up program to determine if additional maintenance is needed.

While only one embodiment of the invention has been described, those skilled in the art will readily recognize adaptations and modifications that may be made to the present invention without departing from the spirit or the scope of the appended claims. Accordingly, the invention is to be limited only by the following claims.

I claim:

1. A vending machine for selling heated food in a pan, the machine comprising a housing with four sides, a base and a top, at least one side being capable of opening, the housing opening side having several slots, one slot for dispensing a heated food in a pan and other slots for accepting money or its equivalent; the housing opening side further comprising a video screen and optionally depressible buttons;

a refrigerator within the housing, the refrigerator having sides, a roof and a floor, the refrigerator roof having an opening door; the side having a fastenable door;

a horizontally rotating apparatus within the refrigerator, said apparatus having a plurality of stations, each station capable of carrying a stack of food pans, with one food pan on top;

an elevator positioned below the roof door, the elevator being capable of elevating a station such that the top food pan is raised above the refrigerator roof;

a means for removing a cover from the food pan;

a plurality of arms radiating from a central hub on top of the refrigerator roof, the arms being rotated horizontally, the arms forming a plurality of spaces for carrying the food pans, whereby the arms push the pans around the refrigerator roof;

an oven comprising a first heating element positioned above the food pan, a second heating element positioned below the pan, and sides formed by the two arms on either side of the food pan and an outer wall connecting the top and bottom of the oven; and a computer to carry out a food selection and to control the refrigerator and oven temperatures.

2. The food vending machine of claim 1 wherein the means for removing the cover from the food pan comprises two closely apposed movable rollers which move in opposite directions and are positioned above the pizza pan and a source of air positioned below the film covering, whereby the air blows upward an edge of the film covering which is then grasped between the two rollers which turn and pull the film covering from the pizza pan.

3. The food vending machine of claim 1, wherein the video screen is a touch screen for selecting the food.

4. The food vending machine of claim 1, wherein the openable door in the refrigerator roof further comprises a motor to slide the door open.

5. A vending machine providing heated pizzas in pans, the vending machine comprising a housing having four sides, a base and a top, at least one side being capable of opening, the side having several slots, one slot for dispensing a pizza and other slots for accepting money or its equivalent; the opening side further comprising a video screen to show available selections and directions and several depressible buttons arranged around the screen;

an insulated vessel within the housing, the vessel having cylindrical or rectangular sides, a top and a bottom, the top having an openable door; the side having a fastenable door through which the pizzas in covered pans can be inserted to refill the machine;

a compressor connected to the vessel to cool the pizzas within the vessel;

a horizontally rotating apparatus within the vessel, said apparatus having a plurality of stations, each station capable of carrying a stack of pizzas, each station separated from the adjacent station with spacers which maintain the stack of pizza pans on the station;

an elevator which is positioned below the openable door of the vessel, the elevator being capable of elevating a station such that a top pizza of the pizza stack is raised out of the vessel;

a means for removing the film covering from a pizza pan, the removing means comprising two closely apposed movable rollers which move in opposite directions and are positioned above the pizza pan and a source of air positioned below the film covering, whereby the air blows upward an edge of the film covering, which is then grasped between the two rollers that turn and pull the film covering from the pizza pan;

a plurality of arms arranged in a spoke-like fashion on top of the vessel, said arms being rotated horizontally by a motor, a plurality of spaces between the arms for containing pizza pans, whereby the arms rotate and push the pizza pan around the top of the vessel;

an oven comprising a first heating element in the top, above the pizza, a second heating element in the base, below the pizza, two sides formed by the arms before and behind the pizza and a lateral side connecting the top and base of the oven; and a computer to control the selection of the pizza to be dispensed, and to control the temperature of the drum and the oven.

* * * * *